US010160260B2

(12) United States Patent
Ericsson

(10) Patent No.: US 10,160,260 B2
(45) Date of Patent: Dec. 25, 2018

(54) DEVICE FOR APPLYING HEAT RADIATION TO A SURFACE

(71) Applicant: SPEEDHEATER SYSTEM AB, Alingsas (SE)

(72) Inventor: Birger Ericsson, Alingsas (SE)

(73) Assignee: SPEEDHEATER SYSTEM AB, Alingsas (SE)

( * ) Notice: Subject to any disclaimer, the term of this patent is extended or adjusted under 35 U.S.C. 154(b) by 230 days.

(21) Appl. No.: 15/102,552

(22) PCT Filed: Dec. 10, 2014

(86) PCT No.: PCT/SE2014/051482

§ 371 (c)(1),
(2) Date: Jun. 8, 2016

(87) PCT Pub. No.: WO2015/088435

PCT Pub. Date: Jun. 18, 2015

(65) Prior Publication Data

US 2016/0311248 A1 Oct. 27, 2016

(30) Foreign Application Priority Data

Dec. 13, 2013 (SE) ..... 1300773

(51) Int. Cl.
*H05B 3/00* (2006.01)
*B44D 3/16* (2006.01)
*B25G 3/38* (2006.01)

(52) U.S. Cl.
CPC ..... *B44D 3/168* (2013.01); *B25G 3/38* (2013.01); *H05B 3/0038* (2013.01)

(58) Field of Classification Search
None
See application file for complete search history.

(56) References Cited

U.S. PATENT DOCUMENTS 572,467 A * 12/1896 Baker ..... D06F 75/24 219/254
1,471,823 A * 10/1923 Boswell ..... D06F 75/36 219/254

(Continued)

FOREIGN PATENT DOCUMENTS

EP 0 485 178 A1 5/1992
EP 1 028 856 B1 8/2000

(Continued)

OTHER PUBLICATIONS

International Search Report, dated Mar. 20, 2015, from corresponding PCT application.

*Primary Examiner* — Thor Campbell
(74) *Attorney, Agent, or Firm* — Young & Thompson

(57) ABSTRACT

A device (1) for applying heat radiation to a surface, for softening and/or removing one or more coatings, includes a head assembly (2) and a handle assembly (3) connected to the head assembly. The head assembly includes at least one heat radiation element (6) arranged in a reflector unit (4), which has an aperture intended to be directed towards the surface to be radiated. The head assembly and the handle assembly are separated by a clearance and at least one heat dissipating member that spans the clearance connects a first attachment area (14) of the head assembly and a second attachment area (16) of the handle assembly. At least a portion of the heat dissipating member has a curvature such that the length of the heat dissipating member exceeds the distance between the first and second attachment areas.

15 Claims, 3 Drawing Sheets

(56) References Cited

U.S. PATENT DOCUMENTS

| | | | | | |
|---|---|---|---|---|---|
| 1,664,429 | A * | 4/1928 | Multhaup | B44D 3/168 | 219/228 |
| 1,762,646 | A * | 6/1930 | Surls | B44D 3/168 | 219/228 |
| 1,881,241 | A * | 10/1932 | Potensa | B44D 3/168 | 219/228 |
| 2,065,366 | A * | 12/1936 | Eichorn | D06F 75/38 | 219/254 |
| 2,497,535 | A * | 2/1950 | Carlino | B44D 3/168 | 219/228 |
| 2,579,726 | A | 12/1951 | Carpenter | | |
| 2,632,087 | A | 3/1953 | Harlingue | | |
| 2,777,933 | A * | 1/1957 | Weaver | A01K 11/005 | 219/227 |
| 3,590,214 | A * | 6/1971 | Kuzyk | B44D 3/168 | 219/228 |
| 4,829,157 | A * | 5/1989 | Loyd | B29C 65/18 | 156/579 |
| 6,546,850 | B1 * | 4/2003 | Akiyama-Warren | A47J 27/12 | 220/573.4 |
| 2007/0280654 | A1 | 12/2007 | Ericson | | |
| 2017/0273505 | A1 * | 9/2017 | MacDonald | A23L 1/01 | |

FOREIGN PATENT DOCUMENTS

| | | | |
|---|---|---|---|
| GB | 354315 | A | 8/1931 |
| GB | 686283 | A1 | 1/1953 |

* cited by examiner

DEVICE FOR APPLYING HEAT RADIATION TO A SURFACE

SUBJECT OF THE INVENTION

The present invention relates to a device for applying heat radiation to a surface, for softening and/or removing one or more coatings on said surface. The device comprises a head assembly and a handle assembly connected to the head assembly. The head assembly comprises at least one heat radiation element arranged in a reflector unit, which reflector unit has an aperture intended to be directed towards the surface to be radiated.

BACKGROUND OF THE INVENTION

It is sometimes necessary to remove one or more layers of coating from a surface. For example, during renovation of old houses, it is normally required to remove several coats of paint from the walls of said houses. Various methods are available for executing this work. For example, the paint removal can be carried out by means of scraping or grinding, which either implies a great effort of costly manpower or diffusion of ecologically harmful dust and disturbing noise. Alternatively, the paint can be burned off or softened by means of heating, to make it easier to scrape the paint off. Blow torches or hot air guns can be utilized for this purpose. However, the open flame of a blow torch constitutes a fire hazard and it is difficult to gain real efficiency and an equally distributed heating to the right temperature with a hot air gun. Caustic solutions or strong hydrocarbon-based solvents have also been utilized for removal of paint from wooden facades. These methods involve various disadvantages, such as negative environmental effects, drying of the wood (resulting in cracks), not to mention the fact that many hydrocarbon based solutions are very toxic.

SE 9000763-4 proposes an alternative solution utilizing a source of infra-red radiation for softening the paint, whereafter the paint is removed by means of mechanical treatment. Further developments of this concept is shown in EP 1 028 856 B1 and US 2007/0280654 A1.

EP 0 485 178 A1 discloses a solution wherein a heating device comprising an infra-red heat source mounted in a reflector unit is used for stripping paint. The heating device is compact and adapted to be held by one hand.

One advantage with compact hand held heating devices is that they are particularly suitable for smaller and hard-to-reach areas. However, it is important to ensure that the handle assembly does not reach temperatures that may cause burn injuries.

OBJECT OF THE INVENTION

The object of the invention is to provide a device for applying heat radiation to a surface, which device is adapted to be held by the operator during use.

SHORT DESCRIPTION OF THE INVENTION

A member connected to another member does not have to be directly connected to that other member. Additional members may be arranged between the connected members.

The term "curvature" relates to the amount by which a line deviates from being straight. The heat dissipating member may have a curvature that varies between 0 and 180°.

The heat radiation intensity is defined as power per surface unit, in the text as W/cm$^2$.

The object is achieved with a device according to independent claim 1.

The device comprises a head assembly and a handle assembly connected to the head assembly. The head assembly comprises at least one heat radiation element arranged in a reflector unit, which reflector unit has an aperture intended to be directed towards the surface to be radiated. The head assembly and the handle assembly are separated by a clearance and at least one heat dissipating member spanning said clearance connects a first attachment area on the head assembly and a second attachment area on the handle assembly. At least a portion of the heat dissipating member has a curvature such that the length of the heat dissipating member exceeds the distance between the first and second attachment areas.

The heat dissipating member is preferably designed such that the length of the heat dissipating member exceeds at least twice the distance between the first and second attachment areas. In many cases may it be desired to have even longer heat dissipating members and the length could be more than 3 times as long, e.g. may the length be in the interval of 5 to 15 times the length distance between the first and second attachment areas.

Heat is transferred from the head assembly to the handle assembly. The heat dissipating member is arranged between the head assembly and the handle assembly to ensure that a sufficient amount of heat is dissipated into the air surrounding the heat dissipating member as it is transferred away from the head assembly, so that the handle assembly is maintained at a suitable temperature.

It is desirable to increase the amount of heat that is dissipated into the air surrounding the heat dissipating member. Heat is transferred from the heat dissipating member to the surrounding air via the surface of the heat dissipating member. It is thus desirable to increase the surface area of the heat dissipating member. However, it is also desirable to use a thin heat dissipating member, because a heat dissipating member with a larger diameter has better heat conducting properties, which means that more heat is transferred to the handle assembly. The solution is to use a curved heat dissipating member. A curved heat dissipating member can be made longer and with a larger surface area without increasing the thickness of the heat dissipating member. Consequently, the curvature of the heat dissipating member improves the heat insulating effect of the heat dissipating member. The heat dissipating member thus ensures that the handle assembly is maintained at a suitable temperature and prevents burn injuries.

The heat dissipating member is advantageously made of a curved element made of any suitable material, for example stainless steel.

The length of the heat dissipating member is the distance between a first end portion of the heat dissipating member, which first end portion is connected to the first attachment area on the head assembly, and a second end portion of the heat dissipating member, which second end portion is connected to the second attachment area on the handle assembly. The length of the heat dissipating member is measured along a line that follows the curvature of the heat dissipating member.

A suitable length for a heat dissipating member is advantageously within the range of from 100 to 600 mm. For example, a suitable length of a heat dissipating member mounted in a device with a heat radiation intensity of 9.25 W/cm$^2$ and aperture dimensions of 90×72 mm is about 315 mm. The distance between the attachment areas, e.g. the attachment point on the handle assembly and the head assembly, may in this case be around 30 mm. The length of the heat dissipating member will in this case be of the magnitude of 10 times the distance between the attachment areas which is well above 3 times the length between the attachment areas and in the middle of a desired length interval of 5 to 15 times this length. In this case will consumed energy effect per length unit (of the heat dissipating member) be around 600 W per 30 cm, i.e. the heat is added at a rate of around 20 W/cm length of the heat dissipating member. It is generally thought that the added heat should be less than 50 W/cm of heat dissipating member. these values are of course also dependent on the dimensions and material used and these values are considered suitable for stainless steel rod or wire having a diameter of about 3 mm.

Advantageously, the heat dissipating member has a relatively thin cross-sectional area. The diameter of the heat dissipating member is advantageously within the range of from 1 to 5 mm, and more advantageously within the range of from 1.5 to 4 mm. The heat dissipating member in the above described example may, for example, have a diameter of about 2.8 mm. The diameter of the heat dissipating member is the diameter of the curved element that constitutes the heat dissipating member.

The cross-sectional area of the heat dissipating member may have any suitable shape. Advantageously, the heat dissipating member has a circular cross-sectional area.

Advantageously, the handle assembly is at least partially made of a plastic with good heat insulating properties. The heat insulating effect of the heat dissipating member ensures that the plastic is maintained at a temperature below the melting temperature of the plastic.

The handle assembly may comprise a handle portion comprising a plurality of layers of plastics with different material properties. The outermost layer may, for example, be softer than the innermost layer. The handle portion may also comprise only one layer of plastic.

The heat dissipating member may have any suitable shape as long as at least a portion thereof is curved in the lengthwise direction of the heat dissipating member. Advantageously, most or all of the heat dissipating member is curved in the lengthwise direction of the heat dissipating member. The heat dissipating member may, for example, have an accordion-like or a helical shape. The heat dissipating member may, for example, have the shape of a helix or a spiral.

Advantageously, the heat dissipating member is resilient and adapted to absorb movements of the head assembly. The heat dissipating member may, for example, be adapted to absorb movements in the longitudinal direction of the heat dissipating member. Advantageously, the heat dissipating member is connected to the reflector unit, in which case it is adapted to absorb movements of the reflector unit.

In some embodiments, the heat dissipating member comprises a coil spring.

In some embodiments, the device may comprise more than one heat dissipating member connecting the head assembly and the handle assembly. This increases the heat dissipating surface area and ensures that more heat is dissipated into the surrounding air.

Advantageously, the head assembly is pivotally connected to the handle assembly, so that the head assembly can be pivoted relative the handle assembly. The pivotable head assembly ensures that the device can be held in an ergonomic manner and makes it easier to reach hard-to-reach areas.

Advantageously, the head assembly is pivotable in any direction. In an alternative embodiment, the head assembly is pivotable about a single axis.

Advantageously, in those embodiments wherein the head assembly is pivotally connected to the handle assembly, the heat dissipating member is pivotally connected to one or both of the head assembly and the handle assembly.

The device comprises one or more heat radiation elements. A heat radiation element may comprise an electric resistance wire. If there are two of more heat radiation elements, these may extend in parallel to each other.

Advantageously, the heat radiation element utilizes a source of infra-red radiation for heating the coating such as the mentioned electrical resistance wire. It is also possible to use other electric heat radiation sources, such as microwave devices.

The paint removal is in general performed manually by physically removing the paint after it has been heated, e.g. by scraping.

The reflector unit is advantageously mounted in a casing that covers at least a portion of the reflector unit. The casing may be formed by extrusion pressing and is preferably made of aluminium. The casing acts as a protective cover that prevents a user from coming into direct contact with the reflector unit. A reflector unit in a hand held device may, for example, be heated to temperatures of about 600° C.

The reflective unit is intended to reinforce the heat radiation and the direction of the heat radiation, by reflecting the heat radiation provided by said heat radiation element towards the aperture. The reflector unit can have many different shapes and comprise any number of heat radiation elements. For example, the reflector unit may comprise a reflective metal sheet arranged in the casing which reflective metal sheet can have a wave-shaped reflective backing wall, suitable for two or more heat radiation elements, or alternatively a flat reflective backing wall, suitable for a single heat radiation element. The reflector unit may further comprise reflective side walls, which suitably are inclined, so that the heat radiation is directed towards the surface to be treated via the aperture.

Alternatively, the casing may in itself comprise side walls which are suitably inclined and at least partly constitute reflective surfaces partially enclosing the heat radiation element, preferably in combination with a reflective backing wall which also may be a part of the casing.

The device is advantageously provided with distance elements, to maintain a suitable distance between the device and the surface which is to be treated. A suitable distance between the at least one electric resistance wire defined above and the surface is 3-15 cm.

The coating to be removed is usually heated to a temperature within the range of from 100 to 200° C., advantageously within the range of from 110 to 165° C.

Throughout this application, the term infra-red radiation refers to electromagnetic radiation with a wavelength from about 0.7 μm to about 1000 μm. For removal of most kinds of paints and coatings a suitable wave length is around 3 μm and optimal absorption for a wide diversity of substances is within the range of from 1 to 3.5 μm.

The term coating includes all kinds of compounds that have been previously applied to a surface, for example, paint and different kinds of plastic coatings. The term paint includes, but is not limited to, oil-, water- and/or plastic-based paints. Different types of varnish are also possible.

A surface is the outermost part of a structural element, for example a wall or a floor. A structural element can be made of one or more materials, including but not limited to wood, concrete and sheet metal.

The heating device has been exemplified for removing paint, which is the intended main purpose of the heating device, but it may of course be used for other heating purposes, e.g. drying. Water have an absorption maximum for IR-radiation having a wavelength of 3 μm and a device suitable for paint removal is thus also suitable for heating water. Still further uses of the heating device for heating surfaces are of course possible.

DRAWINGS

The description will now be described in detail with reference to the accompanying drawings, wherein.

DETAILED DESCRIPTION OF THE INVENTION

The invention will now be described with reference to the accompanying drawings, wherein like characters denote like or corresponding parts.

Figure 1:
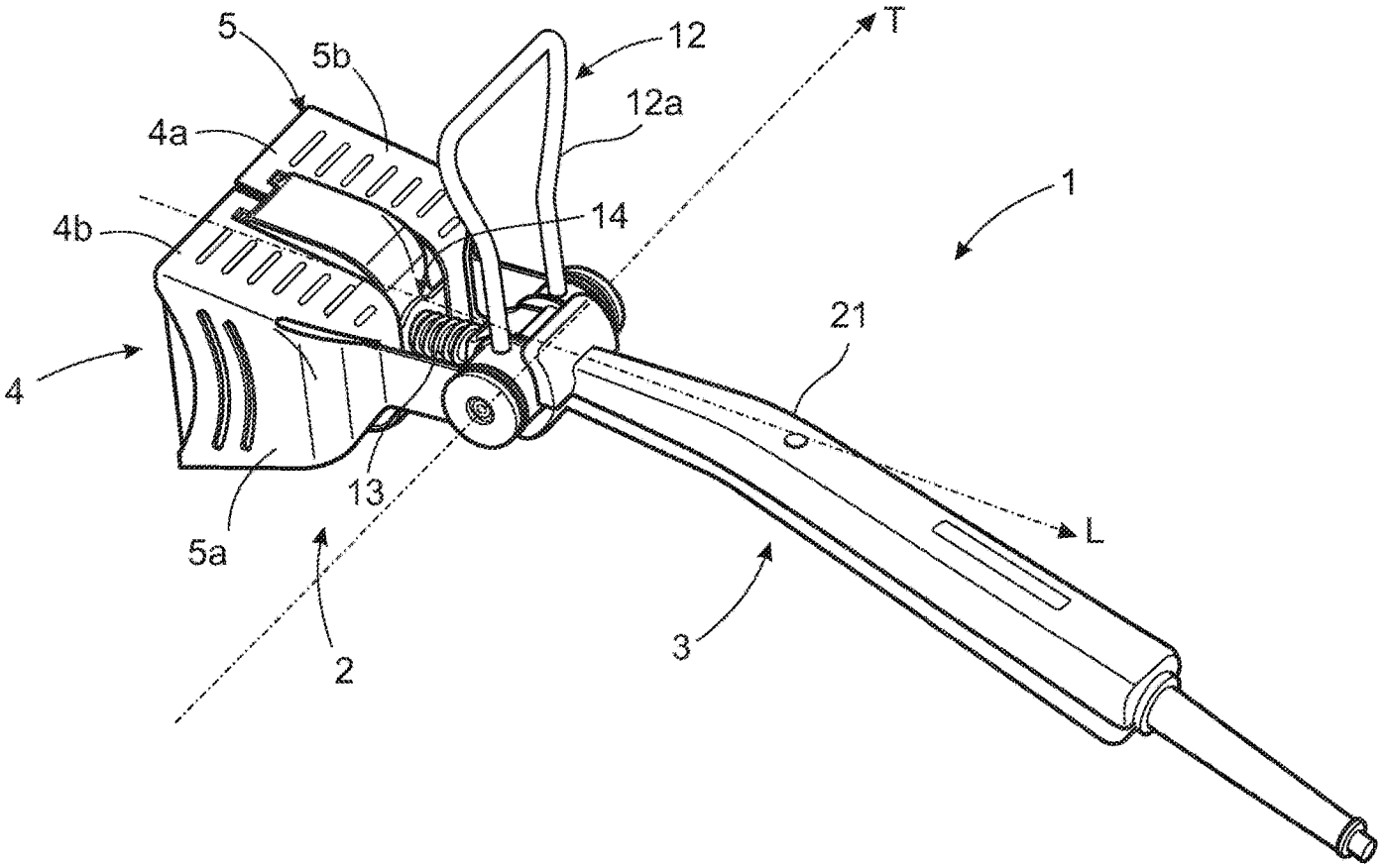
FIG. 1 is perspective view of a device according to a first embodiment of the invention.

FIG. 1 shows a perspective view of a first embodiment of a device 1 for applying heat radiation to a surface. The device 1 comprises a head assembly 2 and a handle assembly 3 separated by a clearance. The device has a longitudinal axis L and a transverse axis T.

Figure 2:
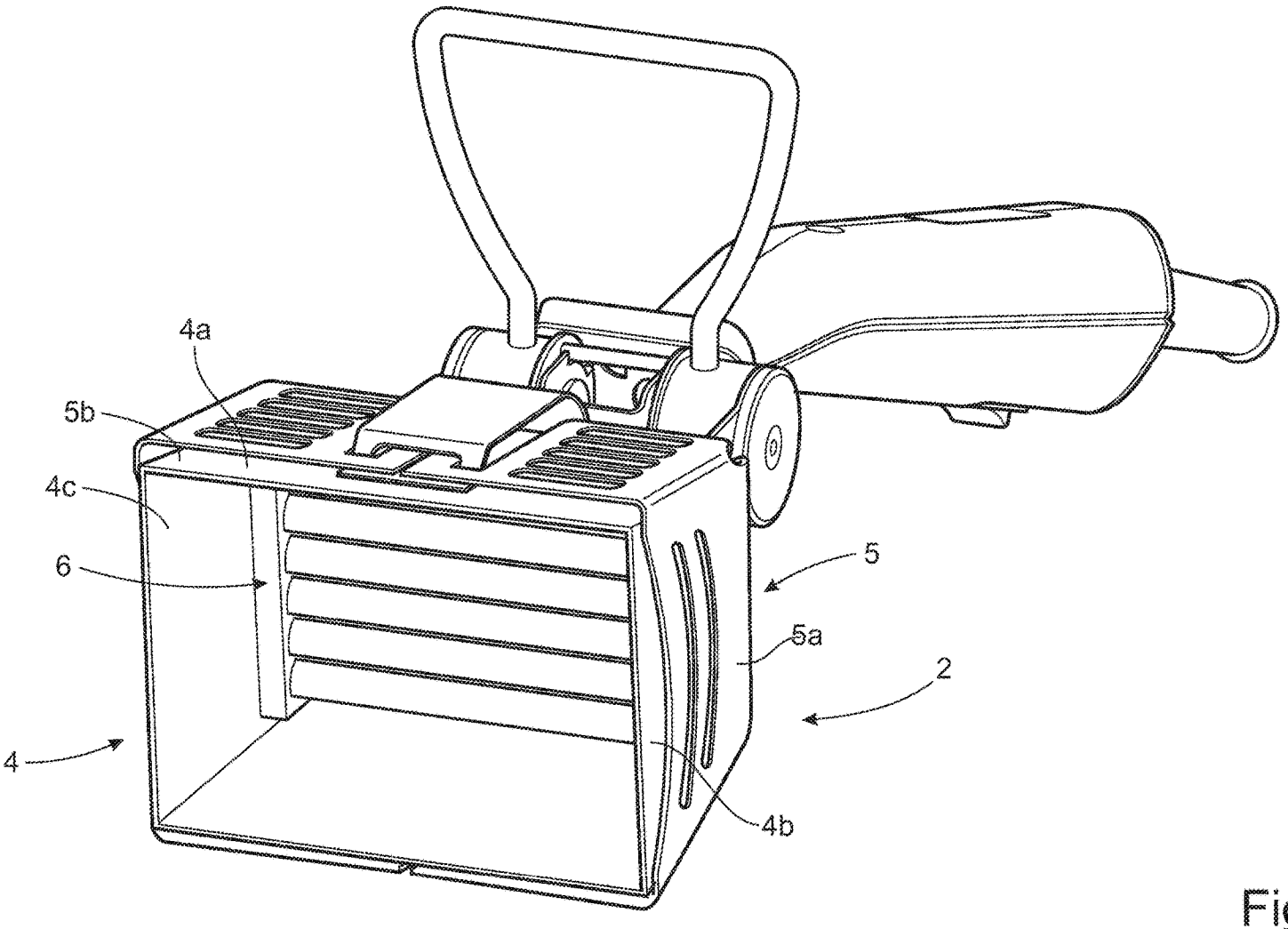
FIG. 2 is a perspective view of the device shown in FIG. 1.

Now referring to FIGS. 1 and 2, the head assembly 2 comprises a reflector unit 4 mounted in a protective casing 5. A heat radiation element 6 comprising a plurality of electric resistance wires arranged in tubes made of quartz crystal is mounted within the reflector unit 4. The reflector unit 4 comprises a U-shaped central part 4*a* and two side walls 4*b*, 4*c* connected to the central part so as to define a space enclosed on five sides, which space houses the heat radiation element 6. The central part 4*a* and the side walls 4*b*, 4*c* also define an aperture intended to face the surface to be treated. Thus, the reflector unit 4 is adapted to reflect the radiation from the heat radiation element 6 towards the surface to be treated.

The skilled person understands that the shape of the reflector unit 4 can be modified in many different ways without departing from the scope of the invention.

The casing 5 comprises two separate casing parts 5*a*, 5*b*, which cover a large portion of the central part 4*a* and the side walls 4*b*, 4*c* of the reflector unit 4. The casing 5 is formed by extrusion pressing and is preferably made of aluminium. The casing 5 acts as a protective cover that prevents a user from coming into direct contact with the reflector unit 4, which may be heated to temperatures of about 600° C. during use of the device 1.

Figure 3:
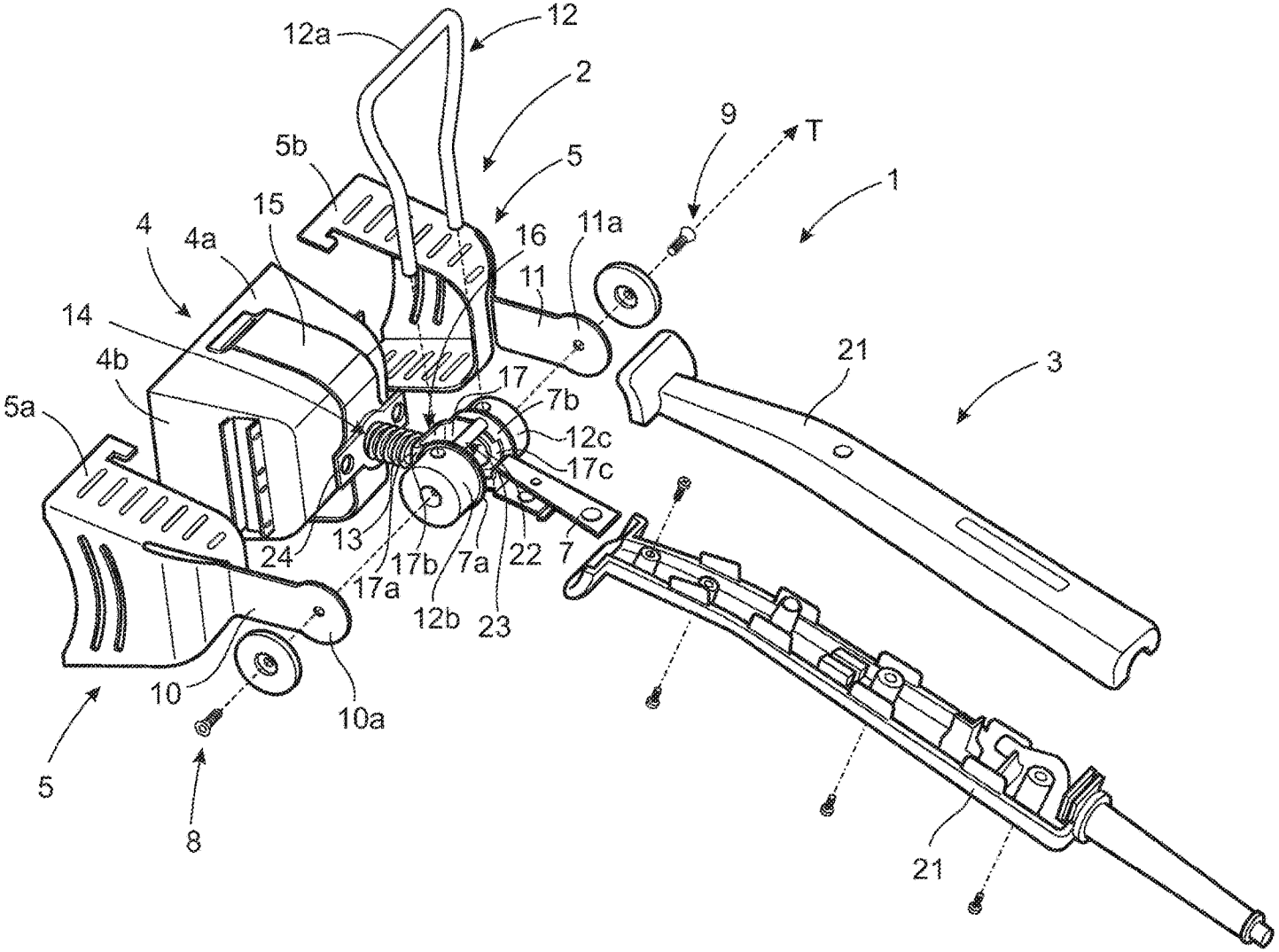
FIG. 3 shows an exploded view of the device shown in FIG. 1.

FIG. 3 is an exploded view that shows how the head assembly 2 is pivotally connected to the handle assembly 3.

The handle assembly 3 comprises a handle portion 21 and a first bracket 7. The first bracket 7 comprises a first end connected to the handle portion 21 and a second end, located opposite the first end as seen in the longitudinal direction of the device 1. The second end comprises two thin end portions 7*a*, 7*b* with a circular cross-section as seen in the transverse direction of the device 1. The end portions 7*a*, 7*b* are located opposite one another along and extend in respective planes perpendicular to the transverse axis T. The end portions 7*a*, 7*b* are pivotally mounted on pins 22 (only one is shown in FIG. 3) that extend through central through holes in the end portions 7*a*, 7*b*.

Each casing part 5*a*, 5*b* is rigidly connected to a respective mounting arm 10, 11. Each mounting arm 10, 11 extends from its corresponding casing part 5*a*, 5*b* in a direction towards the handle assembly 3. Each mounting arm 10, 11 has an outermost section 10*a*, 11*a* (located at a distance from the casing 5) and each outermost section 10*a*, 11*a* extends in a plane perpendicular to the transverse axis T of the device 1. Each end section 10*a*, 11*a* has a through-hole adapted to receive a fastening member 8, 9. In this embodiment, the fastening members 8, 9 are screws. Other types of fastening members 8 are possible. The end sections 10*a*, 11*a* are located outside of the end portions 7*a*, 7*b* of the first bracket 7, as seen in the transverse direction of the device 1.

The head assembly 2 can be rotated about the transverse axis T of the device 1 by means of a head assembly positioning means 12. That is, the head assembly positioning means 12 can be used to adjust the angular position of the head assembly 2. The head assembly positioning means 12 comprises an elongate and curved rod 12*a*, which at opposite ends is connected to two connection elements 12*b*, 12*c*. Each connection element 12*b*, 12*c* has a circular cross-section, as seen in the transverse direction of the device 1, and comprises a central bore that extends along the transverse axis T of the device 1. Each bore is adapted to receive one of the fastening members 8, 9. The inside of the bores are threaded and the threads of the bores are adapted to cooperate with corresponding threads on the fastening members 8, 9. Washers are arranged outside of the end sections 10*a*, 11*a* of the mounting arms 10, 11. Each fastening member 8, 9 extends through one of the washers, through the through-hole in one of the end sections 10*a*, 11*a* of the mounting arms 10, 11 and into the bore in one of the connection elements 12*b*, 12*c*. The fastening members 8, 9 are tightened in the bores to force the end sections 10*a*, 11*a* of the mounting arms 10, 11 into frictional engagement with the connection elements 12*b*, 12*c*. Thus is ensured that the casing 5 rotates with the head assembly positioning means 12.

A heat dissipating member 13 adapted to transfer heat away from the reflector unit 4 is mounted between the head assembly 2 and the handle assembly 3. The heat dissipating member 13 is at a first end welded to a fastening element 24 at a first attachment area 14. The fastening element 24 is attached to a second bracket 15 by means of a pair of screws (not shown) and the second bracket 15 is attached to the reflector unit 4. The heat dissipating member 13 also has a second end welded to a third bracket 17 at a second attachment area 16. The first end of the heat dissipating member 13 is located opposite the second end of the heat dissipating member 13 as seen in the longitudinal direction of the heat dissipating member 13. The third bracket 17 is part of the handle assembly 3 and the second bracket 15 is part of the head assembly 2, so that the heat dissipating member 13 extends from the head assembly 2 to the handle assembly 3.

The second bracket 15 straddles the central portion 4*a* of the reflector unit 4 and is adapted to transfer heat from the reflector unit 4 to the heat dissipating member 13 via the fastening element 24. Some of the heat transferred to the heat dissipating member 13 dissipates into the air surrounding the heat dissipating member 13 and some of it is transferred to the handle assembly 3.

The third bracket 17 comprises a base portion 17*a* connected to the heat dissipating member 13 and two legs 17*b*, 17*c* connected to and extending away from the base portion 17*a*. The legs 17*b*, 17*c* extend in parallel in planes perpendicular to the transverse axis 1 of the device. The two legs 17*b*, 17*c* are located at a distance from one another along the transverse axis 1. Each leg 17*b*, 17*c* is connected to a corresponding connection element 12*b*, 12*c* of the head assembly 12 by means of one of the above mentioned pins 22 (only one is shown). The pins 22 ensure that the third bracket 17 and thus the reflector unit 4 rotates with the head assembly positioning means 12 and the casing 5. As mentioned above, the pins 22 extend through central through-holes in the end portions 7*a*, 7*b* of the first bracket 7, so that the head assembly 2 is allowed to rotate about the transverse axis T of the device in relation to the handle assembly 3.

A stop member 23 extends between the inner surfaces of the end portions 7*a*, 7*b*. The stop member 23 extends through notches in the semi-circular peripheries of the legs 17*b*, 17*c*. The ends of the notches are adapted to cooperate with the stop member 23 to prevent the head assembly 2 from rotating any further in relation to the handle assembly 3. In this embodiment, the head assembly 2 is allowed to rotate relative the handle assembly 3 through an angle of 45° about the transverse axis T of the device 1.

The heat dissipating member 13 shown in FIGS. 1-3 is a coil spring. That is, the heat dissipating member 13 is curved and has a helical shape, so that the length of the heat dissipating member 13 exceeds the distance between the first and second attachment areas 14, 16. Thus is also ensured that the surface area of the heat dissipating member 13 is increased in comparison to the surface area of a straight heat dissipating member with the same diameter. The increased surface area ensures that more heat is transferred from the heat dissipating member 13 to the surrounding air and the increased length ensures that the distance the heat has to travel along the heat dissipating member 13 is increased. The result is that less heat is transferred from the head assembly 2 to the handle portion 21 of the handle assembly 3.

The handle assembly 3 further comprises electronic components housed in the handle portion 21. The handle portion 21 is made of plastic. The heat dissipating member 13 ensures that the amount of heat transferred from the head assembly 2 to the handle portion 21 of the handle assembly 3 is not sufficient to melt the plastic in the handle portion 21.

In conclusion, the curvature of the heat dissipating member 13 ensures that a sufficient amount of heat is dissipated to the air surrounding the heat dissipating member 13, so that the temperature of the handle portion 21 is maintained at a level that allows a user to hold the handle portion without being burned.

The heat dissipating member 13, which is a coil spring, is also adapted to absorb some of the movements of the head assembly 2 and the handle assembly 3. This arrangement allows the device 1 to withstand impact forces generated upon impact with other elements, for example a floor or a wall.

The resiliency of the heat dissipating member 13 and the pivotal connection between the head assembly 2 and the handle assembly 3 also makes the device 1 advantageous from an ergonomical point of view, as these features allow a user to maintain the handle assembly 3 in essentially the same position regardless of the position of the head assembly 2.

In an alternative embodiment of the invention, the device may comprise two or more heat dissipating members 21 connecting the head assembly 2 and the handle assembly 3. The addition of a second heat dissipating member 13 further increases the total surface area of the heat dissipating members 13 and ensures that more heat is dissipated to the surrounding air.

In an alternative embodiment, the head assembly 2 may be rigidly connected to the handle assembly 3.

In an alternative embodiment, the head assembly 2 can be connected to the handle assembly only by means of one or more heat dissipating members 13. That is, the mounting arms 10, 11 that connects the casing parts 5*a*, 5*b* and the handle assembly 3 are optional.

The dimensions of the device 1 are not essential for the invention. Advantageously, the device 1 is intended to be easy to use as a handheld device even though assisting holding devices may be used for holding and positioning the device. A suitable device 1 may for example have an oblong aperture in the reflector unit 4 with a width of 90 mm and a height of 72 mm.

Heat dissipating members may also be used in larger devices intended to be mounted on one or more supporting structures.

The invention is not limited to the embodiments described above, but may be varied within the scope of the appended claims. Also, the above described embodiments and features can be combined in a multitude of ways. For example, the device shown in FIGS. 1-3 may comprise two or more heat dissipating members with a spiral shape and the mounting arms can be removed (the casing 5 can be connected to the reflector unit 4 in many different ways).

The invention claimed is:

1. A device (1) for applying heat radiation to a surface, for softening and/or removing one or more coatings on said surface, which device (1) comprises:

a head assembly (2), the head assembly (2) including a first attachment area (14) and a first connecting part (10*a*, 11*a*);

a handle assembly (3) connected to said head assembly (2), the handle assembly (3) including a second attachment area (16) and a second connecting part (12*b*, 12*c*);

fastening elements (8, 9) fastening the first connecting part (10*a*, 11*a*) of the head assembly (10*a*) to the second connecting part (12*b*, 12*c*) of the handle assembly, wherein the head assembly and the handle assembly are separated by a clearance between the first attachment area (14) on the head assembly (2) and the second attachment area (16) on the handle assembly (3), wherein the head assembly (2) comprises at least one heat radiation element (6) arranged in a reflector unit (4), which reflector unit (4) has an aperture intended to be directed towards the surface to be radiated; and at least one heat dissipating member (13) spanning said clearance and connecting the first attachment area (14) on the head assembly (2) and the second attachment area (16) on the handle assembly (3), wherein at least a portion of the at least one heat dissipating member (13) has a curvature such that a length of the heat dissipating member (13) exceeds a distance between the first attachment area (14) on the head assembly (2) and the second attachment area (16) on the handle assembly (3), and wherein the each heat dissipating member (13) spans said clearance between the first attachment area (14) on the head assembly (2) and the second attachment area (16)

on the handle assembly (3), and each of at least one heat dissipating member (13) has a length of the at least one heat dissipating member (13) exceeds at least twice the distance between the first attachment area (14) on the head assembly (2) and the second attachment area (16) on the handle assembly (3), and the length of each heat dissipating member is the distance between a first end portion of the heat dissipating member, which first end portion is connected to the first attachment area on the head assembly, and a second end portion of the heat dissipating member, which second end portion is connected to the second attachment area on the handle assembly, the length of the heat dissipating member being measured along a line that follows the curvature of the heat dissipating member.

2. The device (1) according to claim 1, wherein the at least one heat dissipating member (13) has a helical shape.

3. The device (1) according to claim 2, wherein the at least one heat dissipating member (13) is a coil spring.

4. The device (1) according to claim 1, which device (1) comprises at least two of said heat dissipating members (13).

5. The device (1) according to claim 1, wherein the head assembly (2) is pivotally connected to the handle assembly (3).

6. The device (1) according to claim 5, wherein the at least one heat dissipating member (13) is pivotally connected to the head assembly (2).

7. The device (1) according to claim 5, wherein the at least one heat dissipating member (13) is pivotally connected to the handle assembly (3).

8. The device (1) according to claim 1, wherein the length of each of the at least one heat dissipating member (13) is more than 3 times as long as the length of the distance between the first attachment area (14) on the head assembly (2) and the second attachment area (16) on the handle assembly (3).

9. The device (1) according to claim 2, which device (1) comprises at least two of said heat dissipating members (13).

10. The device (1) according to claim 3, which device (1) comprises at least two of said heat dissipating members (13).

11. The device (1) according to claim 2, wherein, the head assembly includes a pair of mounting arms (10, 11) and the first connecting part (10*a*, 11*a*) is comprised of end sections of the pair of mounting arms, each end section having an through-hole, the second connecting part (12*b*, 12*c*) of the handle assembly (3) includes a bore that receives the fastening elements (8, 9), and the fastening elements (8, 9) pass through the through-holes of the end sections and through the bore of the second connecting part (12*b*, 12*c*) to thereby provide of pivoting connection between the head assembly (2) and the handle assembly (3).

12. The device (1) according to claim 3, wherein the head assembly (2) is pivotally connected to the handle assembly (3).

13. The device (1) according to claim 6, wherein the at least one heat dissipating member (13) is pivotally connected to the handle assembly (3).

14. The device (1) according to claim 1, wherein the length of each of the heat dissipating member (13) is 5 to 15 times longer than the length of the distance between the first attachment area (14) on the head assembly (2) and the second attachment area (16) on the handle assembly (3).

15. The device (1) according to claim 1, wherein, the head assembly includes a pair of mounting arms (10, 11) and the first connecting part (10*a*, 11*a*) is comprised of end sections of the pair of mounting arms, each end section having an through-hole, the second connecting part (12*b*, 12*c*) of the handle assembly (3) includes a bore that receives the fastening elements (8, 9), and the fastening elements (8, 9) pass through the through-holes of the end sections and through the bore of the second connecting part (12*b*, 12*c*) to thereby provide of pivoting connection between the head assembly (2) and the handle assembly (3).

* * * * *